US007615122B2

(12) United States Patent
Mehus et al.

(10) Patent No.: US 7,615,122 B2
(45) Date of Patent: Nov. 10, 2009

(54) METHOD AND APPARATUS FOR DISPENSING A USE SOLUTION

(75) Inventors: Richard J. Mehus, Richfield, MN (US); Charles A. Hodge, Cottage Grove, MN (US)

(73) Assignee: Ecolab Inc., St. Paul, MN (US)

( * ) Notice: Subject to any disclaimer, the term of this patent is extended or adjusted under 35 U.S.C. 154(b) by 499 days.

(21) Appl. No.: 11/206,618

(22) Filed: Aug. 18, 2005

(65) Prior Publication Data

US 2006/0243743 A1 Nov. 2, 2006

Related U.S. Application Data

(60) Provisional application No. 60/676,899, filed on May 2, 2005.

(51) Int. Cl.
*B08B 3/00* (2006.01)

(52) U.S. Cl. ..... 134/36; 134/100.1; 134/99.2; 417/182; 68/17 R; 68/207; 137/893; 137/895; 22/1; 22/133; 239/310; 239/410

(58) Field of Classification Search ..... 222/132–133, 222/1, 129.2, 145.1, 136, 144.5, 630; 137/891–893, 137/895, 899; 134/99.2, 100.1, 36; 8/158; 68/17 R, 207; 417/182–184; 239/310, 407, 239/410

See application file for complete search history.

(56) References Cited

U.S. PATENT DOCUMENTS

| | | | | | |
|---|---|---|---|---|---|
| 2,240,119 | A * | 4/1941 | Montgomery et al. | .... | 73/861.63 |
| 3,392,747 | A * | 7/1968 | Waldrop | ..... | 137/374 |
| 3,643,688 | A * | 2/1972 | Meinert | ..... | 137/556 |
| 3,799,402 | A * | 3/1974 | Meister et al. | ..... | 222/129.2 |
| RE29,454 | E * | 10/1977 | Ashmead et al. | ..... | 222/1 |
| 4,141,467 | A * | 2/1979 | Augustijn et al. | ..... | 222/38 |
| 4,186,772 | A * | 2/1980 | Handleman | ..... | 137/891 |
| 4,246,969 | A * | 1/1981 | McLoughlin et al. | ..... | 169/13 |
| 4,324,294 | A * | 4/1982 | McLoughlin et al. | ..... | 169/13 |
| 4,651,930 | A * | 3/1987 | Magaha, Jr. | ..... | 239/318 |
| 4,815,634 | A * | 3/1989 | Nowicki | ..... | 222/133 |
| 4,817,825 | A | 4/1989 | Freese | | |
| 5,033,649 | A | 7/1991 | Copeland et al. | | |
| 5,538,160 | A * | 7/1996 | Ziesel | ..... | 222/1 |
| 5,553,746 | A * | 9/1996 | Jones | ..... | 222/129.1 |
| 5,816,446 | A | 10/1998 | Steindorf et al. | | |
| 5,915,592 | A * | 6/1999 | Mehus et al. | ..... | 222/1 |
| 6,256,802 | B1 * | 7/2001 | Stradinger | ..... | 4/432 |
| 6,575,705 | B2 * | 6/2003 | Akiyama et al. | ..... | 417/198 |
| 6,880,191 | B2 * | 4/2005 | Bristor | ..... | 8/148 |
| 7,398,661 | B2 * | 7/2008 | Rizzetto | ..... | 68/17 R |
| 2006/0243743 | A1 * | 11/2006 | Mehus et al. | ..... | 222/133 |

* cited by examiner

*Primary Examiner*—Kevin P Shaver
*Assistant Examiner*—Andrew P Bainbridge
(74) *Attorney, Agent, or Firm*—IPLM Group, P.A.

(57) ABSTRACT

A method and apparatus provides for dispensing a liquid concentrate. The source pressure of a liquid diluent is changed by a boost pump (52) to bring the pressure of the diluent to an elevated pressure. The diluent then enters an aspirator assembly (10) wherein the concentrate and diluent are mixed to form a use solution. The dynamic pressure of the diluent entering the aspirator assembly (10) is sufficient so that the amount of concentrate delivered over time is more constant.

11 Claims, 6 Drawing Sheets

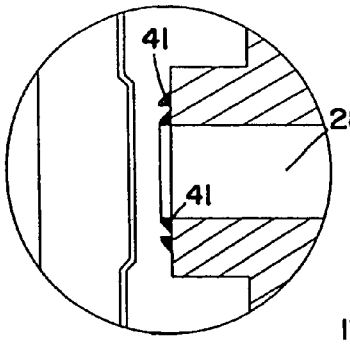
FIG.4
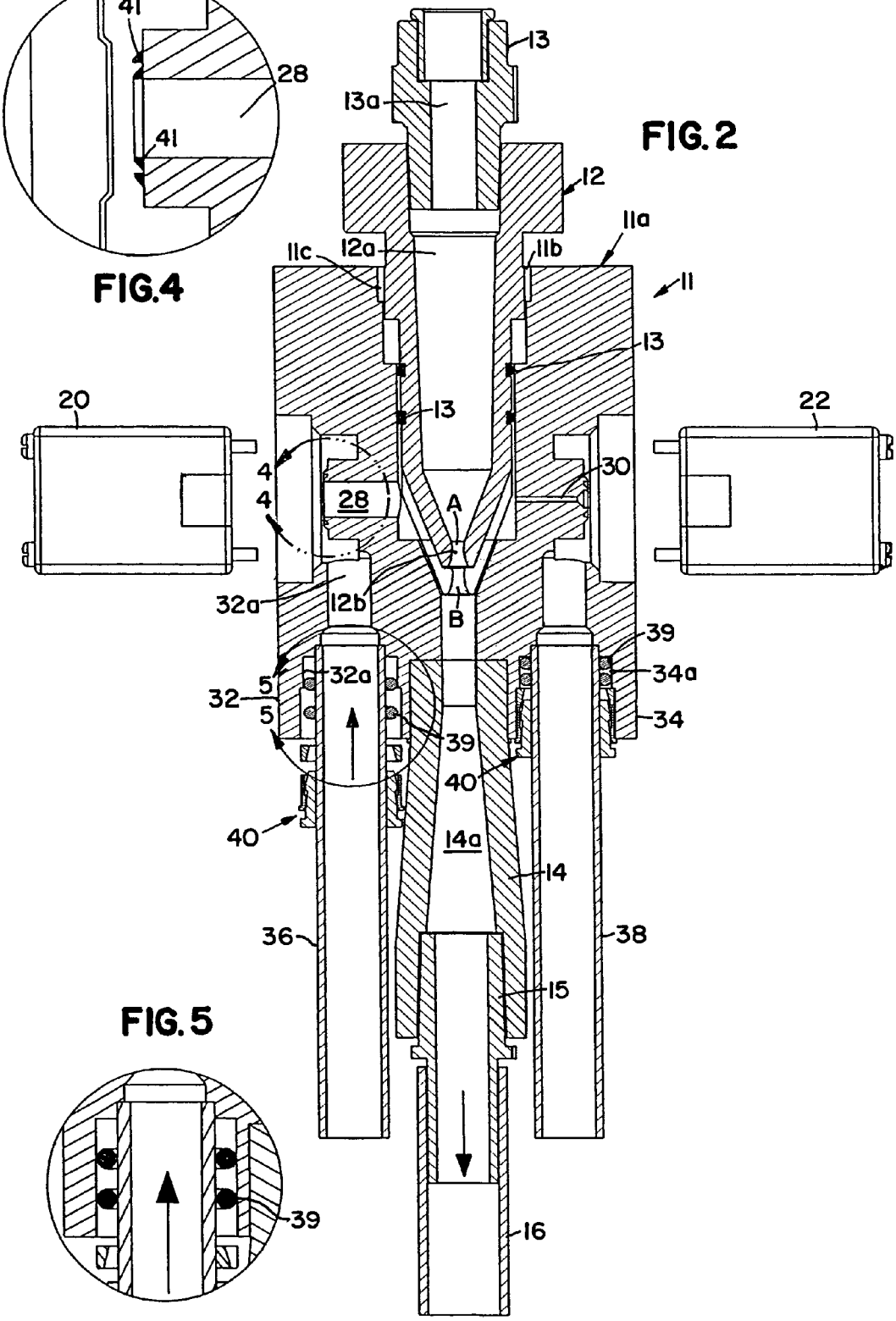
FIG.2
FIG.5

METHOD AND APPARATUS FOR DISPENSING A USE SOLUTION

This application claims priority from U.S. Provisional Patent Application Ser. No. 60/676,899, filed May 2, 2005.

BACKGROUND OF THE INVENTION

1. Field of the Invention

This invention relates generally to a method and apparatus for dispensing a use solution and more particularly to a dispensing system using a diluent boost pump.

2. Description of the Prior Art

Transportation costs associated with an aqueous diluent portion of a formulated aqueous product can be a significant part of the cost of aqueous liquid products as used at a use location. Products, such as sanitizing or cleaning solutions, when used in large amounts can be expensive to use due to transportation costs associated with the aqueous portion. For this reason, many commodity liquid products are shipped from the manufacturers as an aqueous concentrate, an aqueous alcoholic concentrate or as a viscous concentrate to be diluted in a dispenser with an aqueous diluent at the use site. For example, liquid detergents and cleaning solutions used for laundry and warewashing in hospitality locations, institutional or industrial installations such as hotels, hospitals, restaurants, and the like are often shipped as liquid concentrates that are mixed and diluted using a dispensing device at an appropriate ratio to obtain a useful solution.

The dilution of concentrates can be done in many ways, varying from, on one hand, simply manually measuring and mixing to utilizing a computer-controlled dilution device. One common dilution mode involves utilizing a dispensing device that combines, under mixing conditions, a flow of concentrate and a flow of diluent. The flow of the liquid diluent can be directed through an aspirator such that, as the diluent passes through the aspirator, a negative pressure arises inside the aspirator drawing the liquid concentrate into the aspirator to mix with the liquid diluent. Both Copeland et al., U.S. Pat. No. 5,033,649 and Freese, U.S. Pat. No. 4,817,825 and Mehus et al. U.S. Pat. No. 5,915,592 disclose dispensers having aspirators for diluting liquid concentrates to produce liquid products in this general way. Such aspirator-type dispensers have been used for diluting a liquid concentrate.

In a number of applications, it is desired to supply a certain amount of liquid concentrate. In using a timing mechanism wherein the aqueous diluent is used for a certain amount of time, various amounts of concentrate may be dispensed depending upon the pressure of the aqueous diluent.

The present invention addresses this problem and provides for a method and apparatus for delivering a more constant amount of product independent of the pressure of the source of the aqueous diluent.

In addition, the present invention addresses the need for a fail-safe design to prevent the generation of a poisonous gas if an acid and chlorine are mixed in the wrong proportions which may result in a build-up of a poisonous chlorine gas. It is common practice, due to product mixing, to use two lines to keep the chlorine line separate from an acid line.

SUMMARY OF THE INVENTION

In one embodiment the invention is a method of dispensing a liquid concentrate from a dispenser. The method includes providing a supply of liquid diluent at a source pressure. The source pressure is increased to an elevated pressure. The liquid diluent is passed, at an elevated pressure, through a diluent inlet port of an aspirator. A first liquid product is placed in fluid communication with a first product inlet port and a first use solution is dispensed from the liquid diluent and the first liquid product.

In another embodiment the invention is an apparatus for diluting a liquid product with a liquid diluent to form a use solution. The apparatus has a boost pump having a pump inlet for receiving a liquid diluent at a source pressure. The boost pump has a pump outlet for delivering the liquid diluent at an elevated pressure. An aspirator has a diluent inlet for receiving a stream of liquid diluent at the elevated pressure, a nozzle opening for the liquid diluent, a product inlet for receiving a liquid product, and an outlet port for the use solution.

In another embodiment the invention is an apparatus for diluting liquid products with a liquid diluent to form use solutions. The apparatus has a boost pump having a pump inlet for receiving a liquid diluent at a source pressure. The boost pump has a pump outlet for delivering the liquid diluent at an elevated pressure. An aspirator has a diluent inlet for receiving a stream of liquid diluent at the elevated pressure, a nozzle opening for the liquid diluent, first and second product inlets for receiving first and second liquid products, first and second control valves to control flow through the first and second product inlets, and an outlet port for the use solution.

BRIEF DESCRIPTION OF THE DRAWINGS

FIG. 2 is a cross-sectional view of the aspirator shown in FIG. 1;

FIG. 4 is an enlargement of the area in FIG. 2 generally designated by the lines 4-4;

FIG. 5 is an enlargement of an area generally designated by the lines 5-5 in FIG. 2;

DETAILED DESCRIPTION OF A PREFERRED EMBODIMENT

Figure 1:
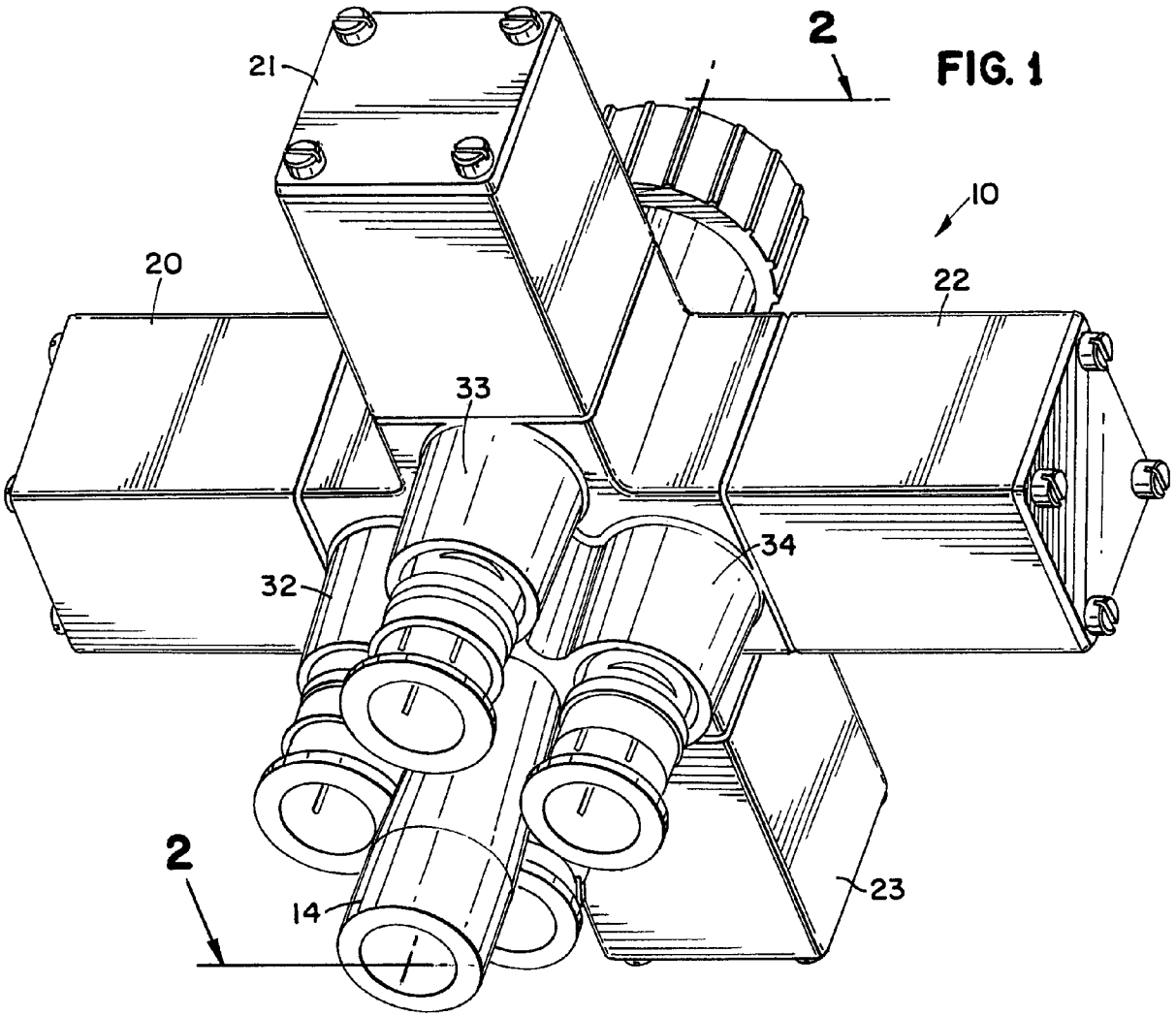
FIG. 1 is a perspective view of an aspirator and solenoid assembly for use in the present invention.

Referring to the drawings, wherein like numerals represent like parts throughout the several views, there is generally disclosed at 10 an aspirator assembly. The aspirator assembly 10 includes an aspirator 11 and four solenoids 20-23. The aspirator 11 is a multi-port aspirator that is designed for dispensing up to four liquid products. A similar single port aspirator is disclosed in U.S. Pat. No. 5,915,592 entitled "Method and Apparatus for Dispensing a Use Solution" issued Jun. 29, 1999 and is hereby incorporated by reference.

Figure 3:
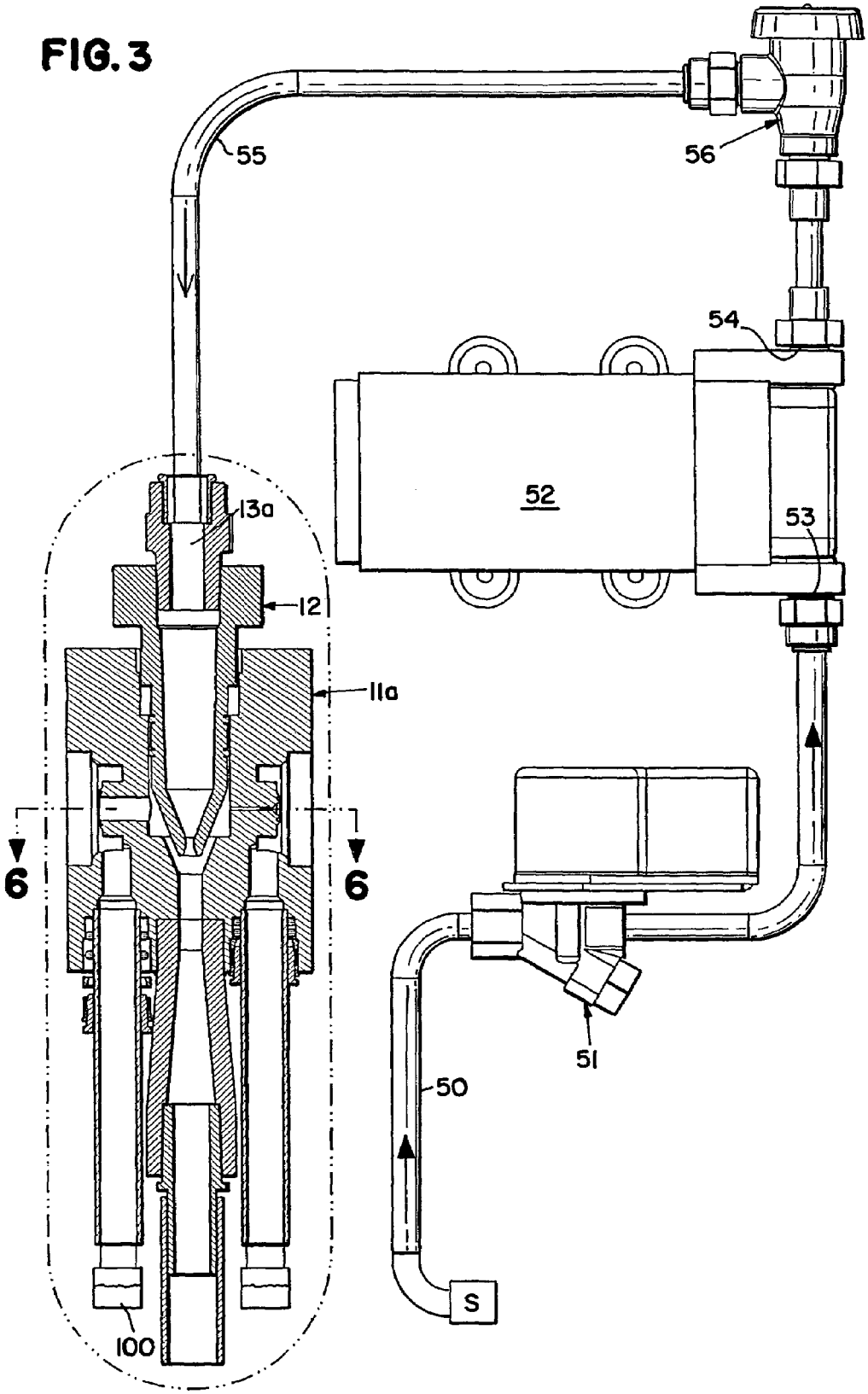
FIG. 3 is a schematic representation of the present invention.
Figure 6:
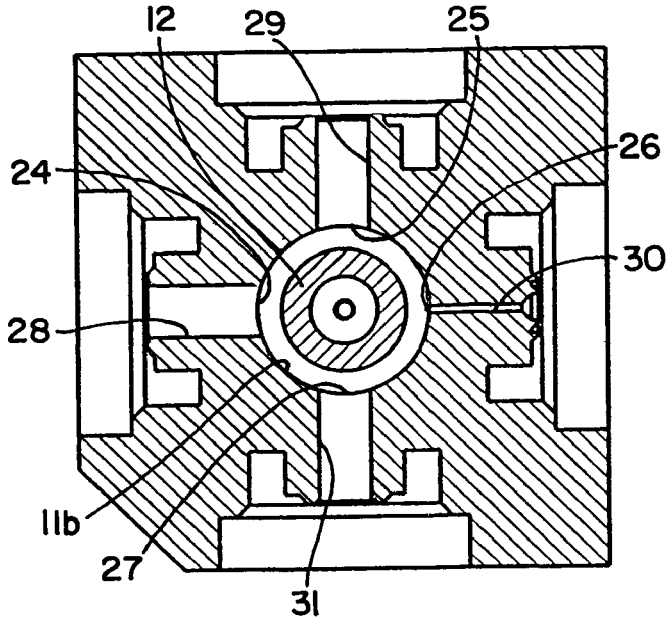
FIG. 6 is a cross-sectional view taken generally along the lines 6-6 as shown in FIG. 3.

The aspirator 11 includes an aspirator body 11*a*. The aspirator body 11*a* has a bore 11*b* into which an adjustable threaded aspirator nozzle 12 is positioned. Two o-rings 13 are positioned in the bore 11*b* and provide for a liquid seal between the bore 11*b* and the nozzle 12. Screw threads 11*c* are formed in the bore 11*b* and mate with matching screw threads on the nozzle 12, thereby allowing the aspirator nozzle 12 to be adjusted either further into the bore 11*b* or further out, as will be described more fully hereafter. A water inlet fitting 13 is operatively connected inside of the bore 11*b*. The water inlet fitting 13 has a passageway 13*a* that is in fluid communication with nozzle passageway 12*a*. The passageway 12*a* has an outlet 12*b* through which the water or other suitable diluent exits the nozzle 12. In viewing FIG. 2, the outlet 12*b* is shown in two positions. In position "A" the nozzle 12 is located for high product volume and for position "B" the nozzle is located for low product volume. A diffuser 14 is positioned in the aspirator body 11*a* and has a passageway 14*a* formed therein. The passageway 14*a* has a first end in fluid communication with the nozzle outlet 12*b* and a second end in fluid communication with a fitting 15 that is positioned at the end of the passageway 14*a*. The fitting 15 is adapted and configured to receive an outlet conduit 16. As seen in FIG. 6, the bore 11*b* has four openings 24-27 which form four product inlets into the bore 11*b*. The openings 24-27 are in fluid communication with passageways 28-31 respectively. The passageways 28-31 may be of a similar diameter or they may be of differing diameters. If the diameter of one passageway is smaller, such as passageway 30 being smaller than the other three passageways 28, 29, and 31, the flow through the passageway 30 will be less, as will be described more fully hereafter. The passageway 30 thereby acts as a product flow restriction. It is understood that other product flow restrictions may alternately be incorporated instead of simply varying the diameters. The aspirator 11 includes four product intakes 32-34 (and one not shown) formed therein. Product conduits 36-39 are operatively connected to each of the product intakes. Suitable fitments may be utilized to allow for a liquid tight seal and an easy coupling for the conduits 36-39. Referring to FIGS. 3 and 5, the product conduit 36 is shown in an uninstalled position and the product conduit 38 is shown in an installed position. O-rings 39 are positioned in the bores 32*a* and 34*a*. A push-in fitment 40 is operatively connected to each of the conduits 36 and 38. The fitment 40 is then pushed into the respective bores 32*a* and 34*a* to secure the product conduits 36, 38 into the intakes 32, 34.

Figure 8:
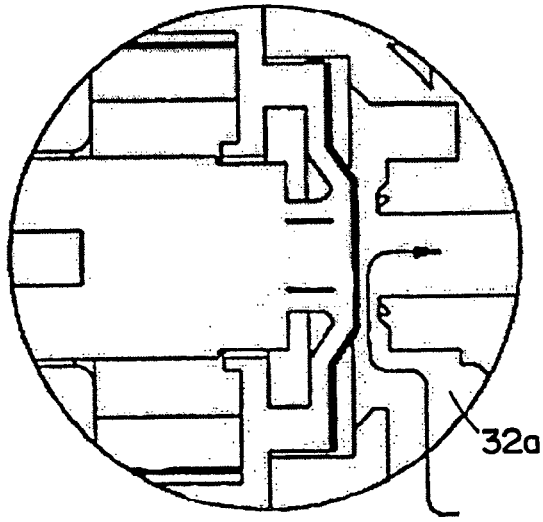
FIG. 8 is a view of the solenoid and aspirator combination shown in FIG. 7 in an open position.
Figure 7:
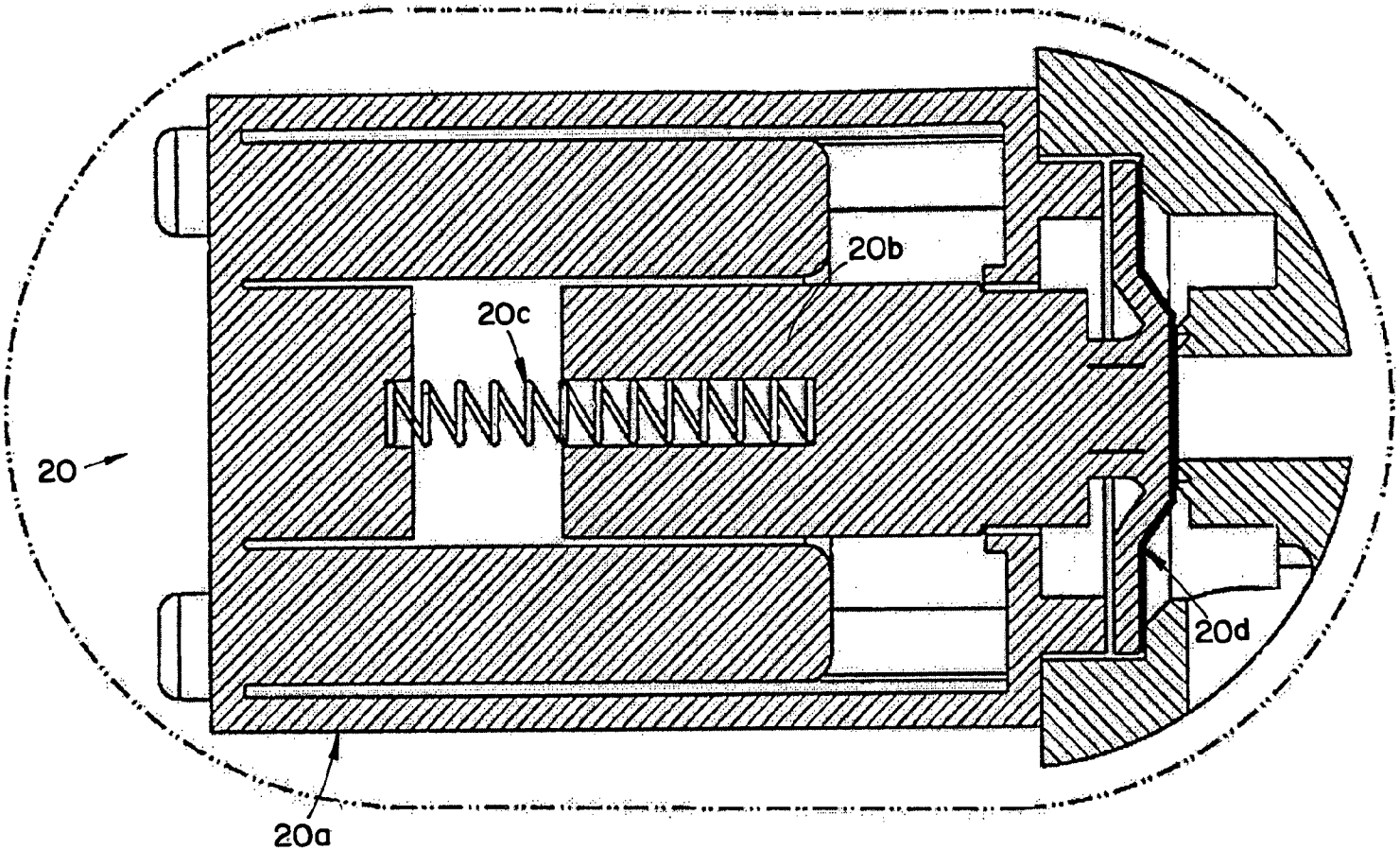
FIG. 7 is an enlarged cross-sectional view of a solenoid and a portion of the aspirator shown in a closed position.

Referring now to FIGS. 4, 7 and 8, it is shown how the solenoids 20-23 control flow of the liquid concentrate through the four product conduits. The operation of the solenoid 20 will be described in detail, it being understood that the operation of the other three solenoids and the flow through the aspirator 11 are similar. The bore 32*a* extends upward and is proximate and in fluid communication with the passageway 28. A double-valve seat 41 is positioned proximate the end of the passageway 28. The fluid flow is shown by the arrow in FIG. 8. The solenoid 20 includes a coil 20*a*, a moveable plunger 20*b* is positioned for movement inside of the coil 20*a*. A tension spring 20*c* biases the plunger 20*b* to the right, or in a closed position. Then when the solenoid is energized, the plunger 20*b* moves to the left and opens the passageway for the liquid to flow. At the end of the plunger 20*b* is carried a valve diaphragm 20*d* that may have a suitable coating such as a fluroelaster (such as Teflon™). The valve diaphragm 20*d* seats against the double valve seat 41, when in a closed position and to thereby stop any flow of fluid through bore 32*a*.

Figure 9:
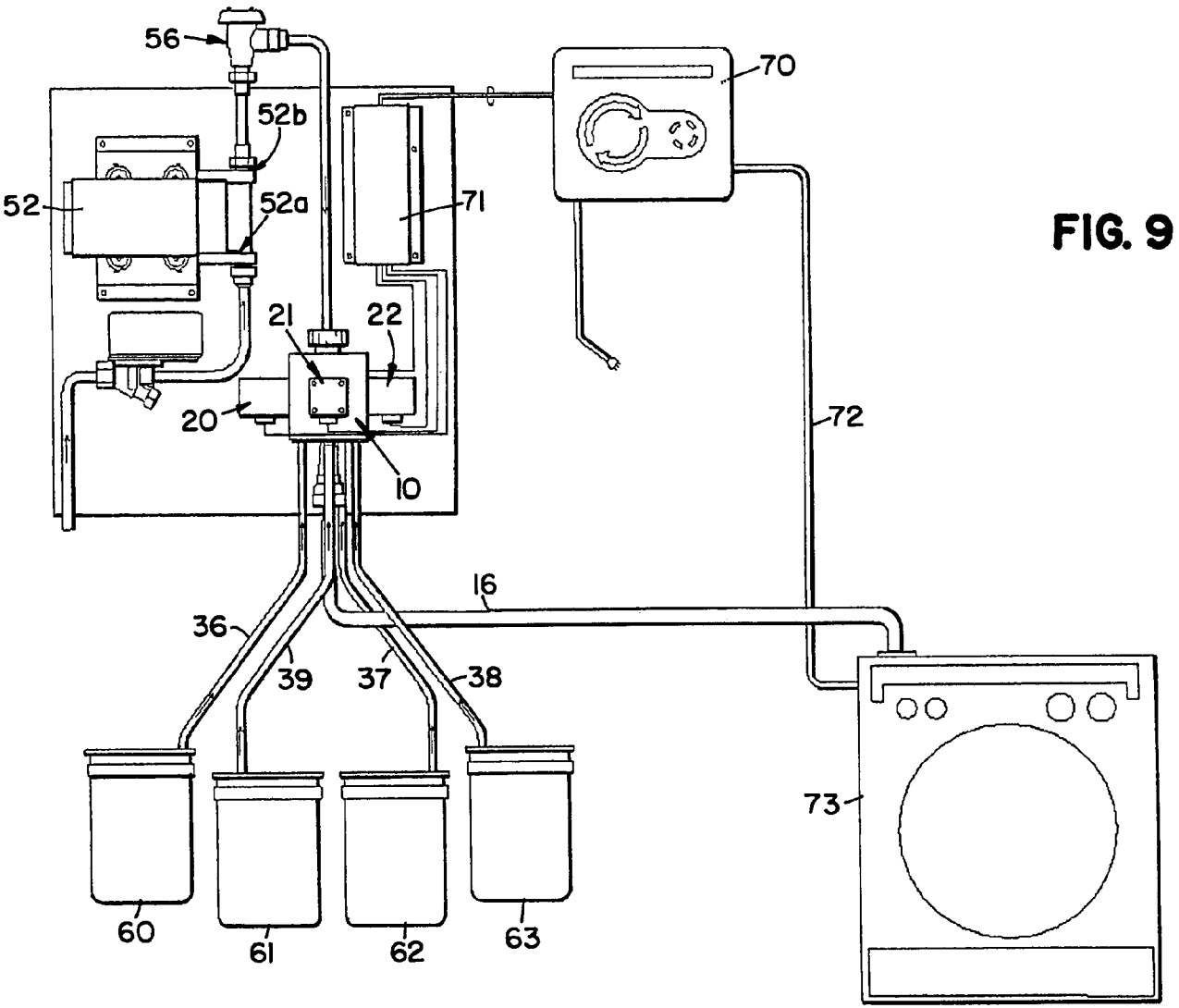
FIG. 9 is a schematic representation of the present invention incorporated into a commercial laundry.

While the previously described aspirator assembly 10 is preferred to be used with the present invention, it is understood that other suitable aspirators and aspirator assemblies may also be utilized. Referring now to FIGS. 3 and 9, there are shown two embodiments of the present invention utilizing one or more aspirator assemblies 10. Water or other suitable diluent, is delivered under a source pressure by a suitable pressure to a water intake conduit 50. This pressure is typically from 30 psi to 50 psi. A suitable water solenoid valve 51 is placed in the flow path of the intake conduit 50 and may be utilized to open and close the flow of the water through the intake conduit 50. The intake conduit 50 is in fluid communication with an inlet 53 of a boost pump 52. The boost pump 52 raises the pressure of the water from the source pressure to an elevated pressure of 70 psig or above. When boosted to this pressure, a differential pressure of 50 psig (345 kilopascals) or more is created. A back pressure of 10-15 psig may be realized in some applications such as when a delivery tube is 50 feet long and goes up vertically as much as 10 feet. The outlet 54 of the boost pump 52 is in fluid communication with the passageway 13*a* via a conduit 55 with an anti-siphon valve 56 positioned in the flow path of the conduit 55. The solenoid 51 is activated, at the appropriate time, to allow water to flow at the source pressure to the boost pump where it is then elevated and enters the aspirator assembly 10. Then, by a suitable controller, not shown, one of the solenoids 20-23 is activated thereby opening the corresponding passageway 28-31. By operation of an aspirator, which is well known in the art, liquid concentrate 100, assuming a solenoid 20 is activated, will flow through the bore 32*a* into the conduit 28 and will be dispensed, along with the water, as a use solution out of the outlet conduit 16. Each of the product conduits 36-39 are suitably connected to a different liquid concentrate. Then, depending upon the product desired, the appropriate solenoid 20-23 is activated to allow that product to be dispensed in a use solution.

In the present invention, because the dynamic pressure differential is 50 psig or greater, a constant maximum vacuum results in a consistent delivery of the concentrate being dispensed when a solenoid valve 20-23 is turned on and off for a specific amount of time. This is not the case when water is delivered at a typical source pressure. This source pressure may vary and the dynamic pressure, in the prior art, will allow varying amounts of liquid concentrate to be dispensed depending upon the maximum vacuum. The present invention is suitable for many applications, but is especially suitable for time-based laundry application. This allows for an easy yet consistent delivery of a set amount of liquid concentrate because of the boost and pressure provided by the boost pump 52. In some cases, a metering effect may be desirable to slow the delivery rate of the liquid products when smaller amounts are needed. A smaller diameter passageway, such as passageway 30.

The above-noted invention may be used for products that include softeners, neutralizers, starch, alkali, chlorine-bleach (such as one with a 12% maximum strength), or detergent. Further, the invention is designed to dispense one product at a time. However, when designing such dispensers, one has to worry about a fail-safe position to prevent the possible build-up of chlorine gas. Many complex fail-safe units have been incorporated into the dispensers. However, the present invention provides for an easy fail-safe to prevent the build-up of chlorine gas. As long as the higher pH found in 12% sodium hypochlorite (bleach) is present in amounts sufficient to keep the pH of the solution above a pH of 4, chlorine gas cannot be produced. The ratio shown is 10 to 1, which provides a greater margin of error. A ratio of 8:1 is also sufficient to produce the required use solution with a suitable pH. At 10:1, there is 20 parts water from the aspirator nozzle, 10 parts of chlorine and 1 part of acid from the solenoid valves. It is at a pH of 4 or lower that the chlorine gas is generated. Therefore, it may be desirable to keep the pH above 5 or higher to provide an extra margin of safety. This can be determined, based on the concentration mix of the chlorine bleach having an alkali or higher pH and acid with the acidic or lower pH, what ratio is needed to keep the pH above the critical number. Therefore, even if by accident both of the solenoids that operate the bleach and the acid are opened at the same time, by designing the passageway for the acid into the bore 11*b* to be of such a size as to restrict the flow, as compared to the flow from the passageway of the bleach, chlorine gas would not be produced. It is necessary for the design of the aspirator 11 to have the size of one of the bores, such as bore 28 to be sized greater than bore 30 so that the flow through bore 28 is at a sufficient multiple of the rate of the flow through bore 30 to prevent a pH of 4 or below. The reduction in bore size of bore 30, as compared to bore 28 provides for a suitable flow restriction to limit the flow of one of the products to maintain a desired ratio and thus prevent the build-up of a chorine gas. In the present example a ratio of 10:1 will create a use solution with a pH of approximately 5.6. Unlike the prior art, there is never going to be a concentrated product mixing as water is the only motive force to move the concentrate, i.e. the water pressure through the aspirator causing the vacuum. The concentrates will always be diluted with water in mix ratios that are inherently safe. The water portion of the mix is variable depending on the water pressure entering the nozzle assembly. As water pressure goes up the volume exiting a known orifice will increase. However, with an aspirator once the differential pressures exceeds 50 psig there is a constant vacuum regardless of how much higher the differential pressure increases. With this in mind the mix ratios of the chemistry are constant due to constant vacuum. The mix ratios are a function of the orifices from the chemical valves entering the mixing zone within the aspirator. What this invention achieves is a solution that never gets below pH 4 when dispensing acid and chlorine simultaneously, which would happen only if there was a failure. The acid product is designed to be only on the valve with the flow restrictor. With variable pressure, the solution strength will vary while the chemical mix ratios remain constant.

While the previous figures have illustrated the use of an aspirator assembly for use with four products, it is understood that if additional products are to be used, a second aspirator assembly could be utilized. It would only be necessary that a three-way valve be inserted to direct flow from the water inlet 13 to direct water flow to either the first or second aspirator assembly 10. For instance, one of the aspirator assemblies 10 could be used to dispense a softener, neutralizer, antichlor or starch. The second aspirator assembly could be used for dispensing alkalis, detergent, bleach and starch. These of course are just examples of the various products that could be utilized.

Referring now to FIG. 9, there is shown an aspirator assembly 10 incorporated into a commercial laundry. The four product intakes 32-35 are connected to four containers 60-63, through conduits 36-39, that contain the four products to be dispensed. A suitable controller 70 provides a low voltage connection to the solenoids 20-23 through an electrical connection 71. The controller 70 receives a signal via a connection 72 to the laundry machine 73. The outlet conduit 16 is in fluid communication with the laundry machine 73 to provide the product. The boost pump 52 is shown with a pump inlet check valve 52*a* and a pump outlet check valve 52*b*. This or other suitable connections may be utilized to incorporate the aspirator assembly 10 into an apparatus utilizing a use solution.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A method of dispensing a liquid concentrate from a dispenser for a laundry based application, comprising:

(a) providing a supply of liquid diluent at a source pressure;

(b) increasing the source pressure to an elevated pressure, the elevated pressure is a differential pressure of 50 psig or more;

(c) passing the liquid diluent at the elevated pressure through a diluent inlet port of an aspirator;

(d) placing a first liquid product in fluid communication with a first product inlet port; and (e) dispensing a first use solution from a mixture of the liquid diluent and the first liquid product, wherein the first use solution has a given concentration independent of the source pressure.

2. The method of claim 1, the dispenser having a first controllable valve to control flow through the first product inlet port, the method further comprising opening the first controllable valve for a predetermined time, wherein an amount of liquid product dispensed is independent of the source pressure.

3. The method of claim 2, the dispenser having an adjustable aspirator nozzle, the method further comprising adjusting the adjustable nozzle to control flow of the first liquid product.

4. The method of claim 2, the dispenser further having a second product inlet port, the method comprising:

(a) placing a second product in fluid communication with the second product inlet port;

(b) activating a second controllable valve to control flow through the second product inlet port; and (c) dispensing a second use solution from a mixture of the liquid diluent and the second liquid product.

5. The method of claim 1, wherein a boost pump is used to obtain the elevated pressure.

6. The method of claim 4, further comprising:

(a) the first liquid product is chlorine delivered through a first passageway;

(b) the second liquid product is an acid delivered through a second passageway;

(c) the liquid diluent is water;

(d) sizing the first and second passageway so as to have a combined use solution having a pH of 5.0 or greater when both the liquid products are being dispensed, since the first and second liquid products are dispensed at a constant rate independent of the source pressure.

7. A method of dispensing a liquid concentrate from a dispenser for a warewashing based application, comprising:

(a) providing a supply of liquid diluent at a source pressure;

(b) increasing the source pressure to an elevated pressure, the elevated pressure is a differential pressure of 50 psig or more;

(c) passing the liquid diluent at the elevated pressure through a diluent inlet port of an aspirator;

(f) placing a first liquid product in fluid communication with a first product inlet port; and (g) dispensing a first use solution from a mixture of the liquid diluent and the first liquid product, wherein the first use solution has a given concentration independent of the source pressure.

8. The method of claim 7, the dispenser having a first controllable valve to control flow through the first product inlet port, the method further comprising opening the first controllable valve for a predetermined time, wherein an amount of liquid product dispensed is independent of the source pressure.

9. The method of claim 8, the dispenser having an adjustable aspirator nozzle, the method further comprising adjusting the adjustable nozzle to control flow of the first liquid product.

10. The method of claim 7, the dispenser further having a second product inlet port, the method comprising:

(a) placing a second product in fluid communication with the second product inlet port;

(b) activating a second controllable valve to control flow through the second product inlet port; and (c) dispensing a second use solution from a mixture of the liquid diluent and the second liquid product.

11. The method of claim 7, wherein a boost pump is used to obtain the elevated pressure.

* * * * *

UNITED STATES PATENT AND TRADEMARK OFFICE

CERTIFICATE OF CORRECTION

PATENT NO. : 7,615,122 B2
APPLICATION NO. : 11/206618
DATED : November 10, 2009
INVENTOR(S) : Mehus et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 937 days.

Signed and Sealed this

Nineteenth Day of October, 2010

David J. Kappos

David J. Kappos
*Director of the United States Patent and Trademark Office*